United States Patent [19]

Roden

[11] Patent Number: 4,978,057

[45] Date of Patent: Dec. 18, 1990

[54] MAILBOX SIGNAL

[76] Inventor: Walter C. Roden, 14013 Wyandotte Dr., SW., Huntsville, Ala. 35803

[21] Appl. No.: 497,131

[22] Filed: Mar. 19, 1990

[51] Int. Cl.[5] ..... B65D 91/00

[52] U.S. Cl. ..... 232/35

[58] Field of Search ..... 232/35, 34, 17

[56] References Cited

U.S. PATENT DOCUMENTS

| | | | |
|---|---|---|---|
| 2,421,603 | 6/1947 | Doppelhammer | 232/35 |
| 3,143,287 | 8/1964 | Holt | 232/35 |
| 3,602,424 | 8/1971 | Raulston | 232/35 |
| 3,650,464 | 3/1972 | Lewis | 232/35 |
| 3,815,811 | 6/1974 | Harmon | 232/35 |

*Primary Examiner*—Robert W. Gibson, Jr.

*Attorney, Agent, or Firm*—John C. Garvin, Jr.

[57] ABSTRACT

A self-contained signalling device for attachment to a rural type mailbox mounted along the side of a road for alerting the owner of the mailbox that mail has been deposited therein by the mail carrier. The signalling device includes a brightly colored flag carried by a pivotally mounted flag support assembly which is actuated upon the opening of the door of the mailbox to cause the flag to lower itself from a folded non-signalling position to an extended signalling position. After removing mail from the mail box, the signalling device is easily raised by the owner of the box to reset the signalling device to its folded non-signalling, position to be reactuated by the mail carrier when the next delivers mail to the box.

20 Claims, 5 Drawing Sheets

MAILBOX SIGNAL

BACKGROUND OF THE INVENTION

The invention of the present application relates to mailboxes of the rural type which are normally mounted along the side of a road or highway, and is particularly concerned with a signal associated with such mailboxes which will inform the owners of the mailboxes that mail has been deposited therein.

It is common for mailboxes in rural areas to be located at a considerable distance from the residence of the owner. Since it is normally not feasible to keep a continuous watch on the box and since a comparatively long trip will be required, where the distance from the highway or road to the house is great, to determine whether the mail has been delivered, it is desirable to have means associated with the mailbox whereby a resident can be informed that mail has been placed in the mailbox by the mail carrier.

Without a signalling device of some sort it becomes necessary for the owner of the mailbox to actually open the door of the mailbox to determine whether or not mail has been deposited therein. In view of this, there has been a number of proposals for automatic signalling devices to indicate when the door of the mailbox has been opened, this being an indication that mail has been delivered to the mailbox since the mail carrier is ordinarily the only person other than the recipient of mail (the owner of the mailbox or a member of his family) to open the mailbox under normal circumstances.

A search of the U.S. patents in this area has disclosed a number of such devices. Such devices have not been widely accepted even though the intended devices would provided a substantial convenience to people who have mailboxes mounted some distance from the house adjacent a road or highway. Accordingly, it is believed that there is a need to provide a signalling device for rural type mailboxes which is practical, reliable, easy to install and operate, and of a design which is relatively economical to manufacture.

The search of the U.S. patents disclosed a large number of devices for use with rural type mailboxes to convey to the owner of a mailbox that the mail carrier had made a delivery to the mailbox. U.S. Pat. Nos. 4,147,292, 4,182,479, 4,491,268, 4,492,335, 4,524,905, 4,570,846, 4,711,391, 4,738,392, 4,754,918, 4,756,472, 4,759,496, 4,778,103, 4,793,552, 4,798,326, and 4,811,895 illustrate such prior art devices.

It is an object of the present invention to provide a signalling device for rural type mailboxes which can be easily installed on an existing mailbox, which can operate reliably and effectively, which does not interfere with the normal operation of the mailbox, and which has a design which lends itself to economical manufacture.

It is a further object of the present invention to provide a signalling device which can be easily mounted on a conventional mailbox with minimal damage, if any, to the structural integrity of the mailbox.

It is yet a further object of the present invention to provide a readily attachable and detachable signal device for a mailbox which is automatically tripped when the mailbox door is opened so that a signal is given to the owner of the mailbox that mail has been deposited in the box.

The present invention satisfies these objects by providing a self-contained mailbox signalling device for attachment to a standard mailbox.

DESCRIPTION OF THE INVENTION

Figure 1:
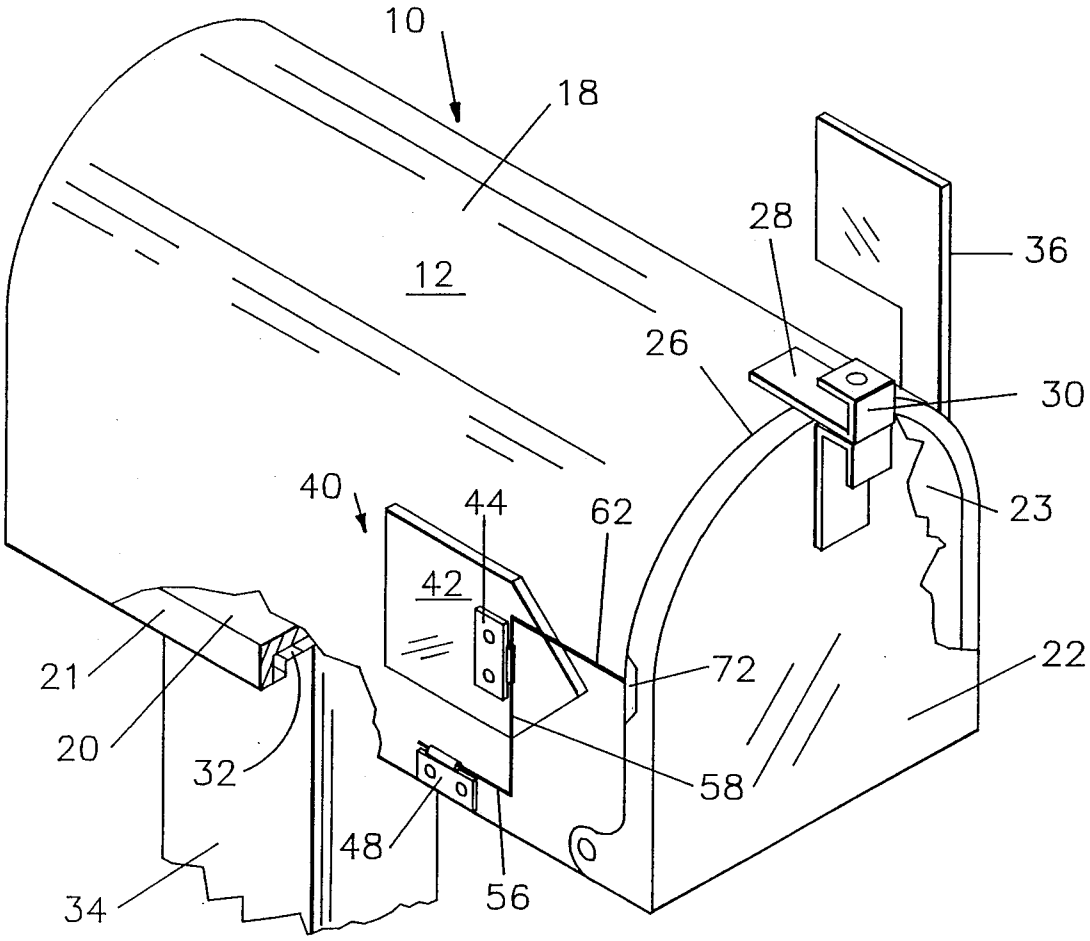
FIG. 1 is a perspective view of a rural type mailbox provided with a signal device according to the present invention shown mounted on a post.

FIG. 1 shows, in perspective, a typical rural mailbox 10 comprising an enlongated body portion 12 having a back wall 14, two substantially parallel side walls 16, a curved top wall 18, a raised floor or bottom 20 having downwardly extending flanges 21, an open front end 23, and a swinging door 22 pivotably mounted at 24 to the lower front edge portion of the two side walls 16. The door 22 has a peripheral lip or flange 26 which extends rearwardly from the upper and side edges of the door 22. With the door 22 in its closed position, the lip or flange 26 extends rearwardly a short distance around the outer surface of the forward portions of the side walls 16 and top wall 18 of box 10. Cooperating catch devices 28 and 30 are attached to the top wall 18 and door 22, respectively, and these engage one another to releasably hold the door 22 in its closed position.

The components 10 through 30 described thus far are those which exists in many, if not most, conventional rural type mailboxes currently in use. Mailbox 10 may be supported in any suitable manner, for example, by securing the floor or bottom 20 of body portion 12 by suitable means such as bolts (not shown) to a plate 32 carried on the upper end of a post 34, the lower end of which can be secured in the ground. As shown in FIG. 1, mailbox 10 may be provided with the conventional flag 36 used to inform the mail carrier that the box contains mail ready for posting.

As will be disclosed more fully in the following detailed description, the present invention is particularly adapted to be used in an especially convenient manner with such conventional mailboxes, mounted on either side of such mailboxes, not only with ease of installation with minimal tools, but also with effective and reliable use to alert the owner that the box contains mail delivered by the mail carrier.

Figure 2:
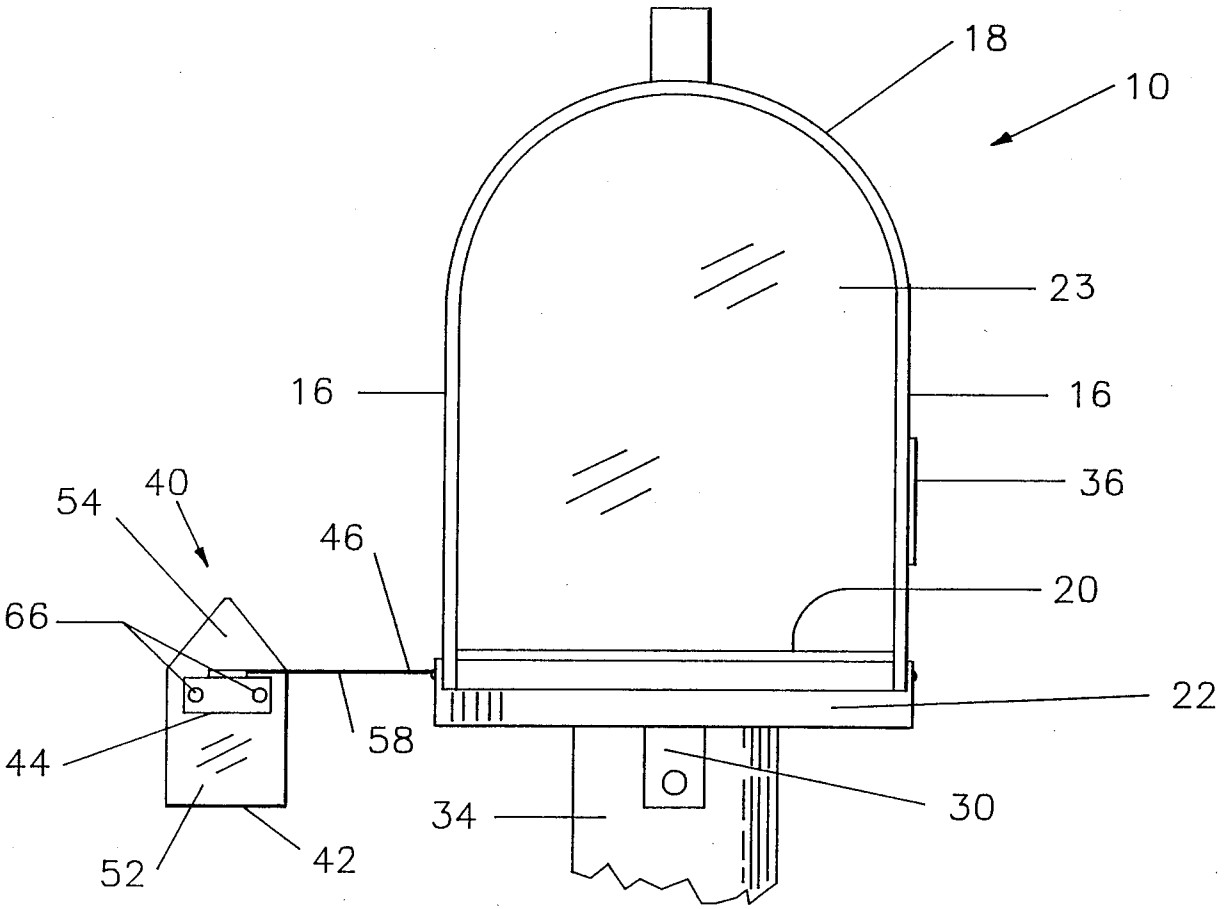
FIG. 2 is a front elevational view of the device of FIG. 1 with the door of the box open illustrating one embodiment of the signal device of the present invention in its lowered, signalling position.
Figure 3:
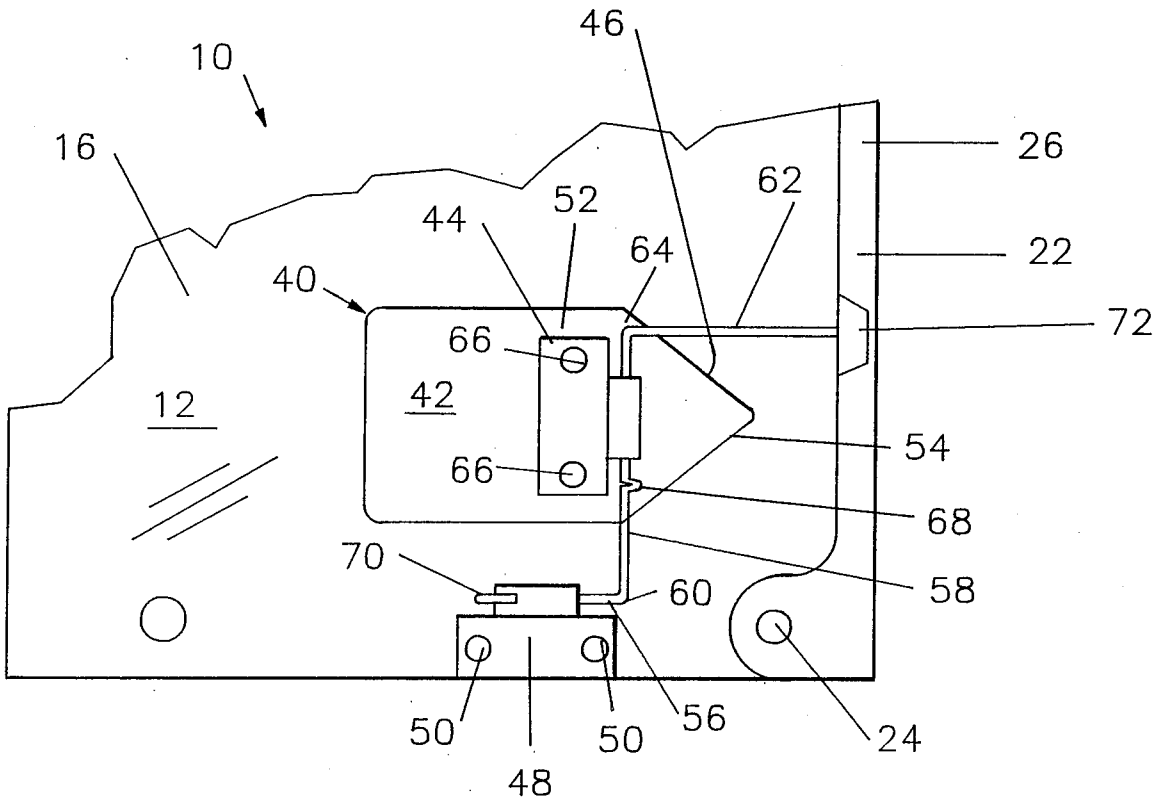
FIG. 3 is an enlarged, fragmentary side elevational view of the signal device illustrated in FIG. 1.

The embodiment of the signalling device of the present invention as illustrated in FIGS. 2 and 3 is generally designated by reference numeral 40 and comprises a flag plate 42, a first hinge member 44, a rigid wire or filament 46, a second hinge member 48 and two screws 50 (or any other conventional means such as rivets, adhesives or the like) for securing the signalling device 40 to the forward portion of one of the side walls 16 of the box below the floor or bottom 20 of the box adjacent the pivot point 24 for the swinging door 22. Flag plate 42 has an enlongated, rectangular, shaped end portion 52 and a triangular shaped end portion 54. The rectangular shaped end portion 52 of flag plate 42 primarily serves to provide the visual means for indicating to the owner of box 10 that the mail carrier has left mail in box 10. The triangular shaped end portion 54 of flag plate 42 not only helps to alert the owner of box 10 that the mail carrier has placed mail into box 10, but it also serves as a means for urging the face plate 42 against the side wall 16 of box 10, when signalling device 40 is in its raised, non-signalling position, to prevent the wind and other elements from causing the signalling device 40 to flap against the side wall 16 of box 10. The wire or filament 46, shaped as best shown in FIG. 3, includes a first end section 56, an intermediate section 58 bent at an angle (preferably ninety degrees) from the first end section 56 at point 60, and a second end section 62 bent at an angle (preferably ninety degrees) to the intermediate section 58 at point 64 in a direction opposite to that for the first end section 56. Flag plate 42 is secured to the first hinge member 44 through rivets 66 or any other conventional means such as screws, adhesives or the like, and is pivotably mounted on the intermediate section 58 of filament or wire 46 by the first hinge member 44. The intermediate section 58 of filament 46 might by crimped or bent upon itself as shown at 68 to restrict sliding movement of the first hinge member 44 and flag plate 42 along intermediate section 58. The first end section 56 of filament 46 is pivotably supported by second hinge member 48. The distal portion of the first end section 56 of filament 46 is bent over as shown at 70 to engage the face of second hinge member 48 to provide a stop for limiting the movement of the signalling device 40 when it falls to its lowered signalling position to indicate that mail is in the box 10. The second end section 62 of filament 46 is of a length that it extends to the forward end of side wall 16 of mailbox 10 so that its distal end can be tucked under flange or lip 26 of door 22 when the door 22 is closed and signalling device 40 is in a raised, non-signalling position. With most conventional mailboxes, the lip or flange 26 of door 22 must be bent slightly outward as shown at 72 to allow the lip or flange 26 of door 22 to surround the distal end of second end section 62 of filament 46 to allow a complete closing of door 22.

Figure 4:
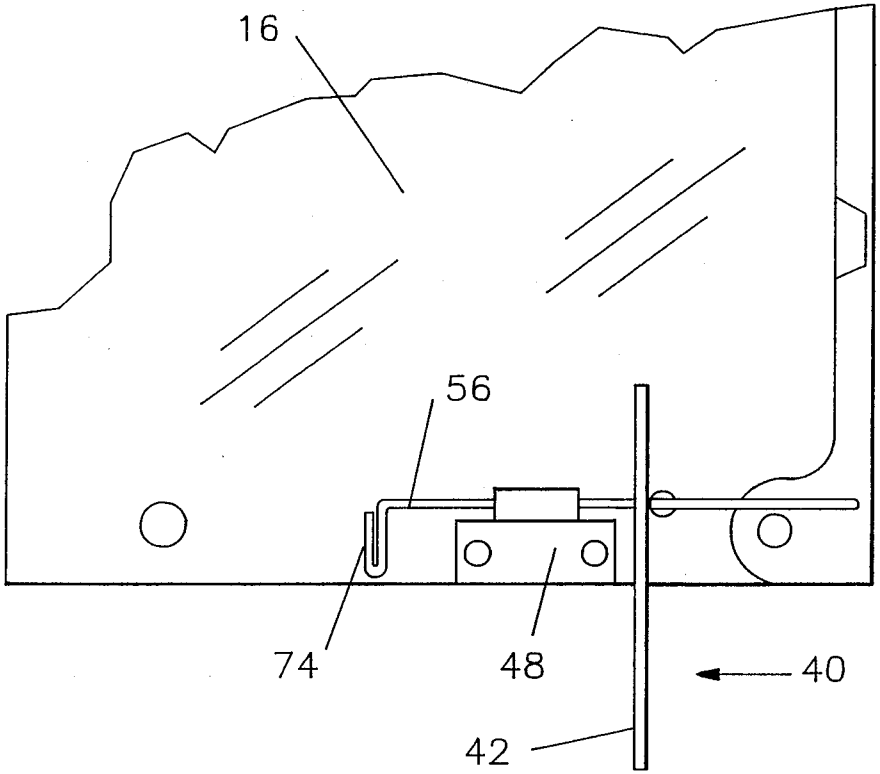
FIG. 4 is an enlarged, fragmentary side elevational view of another embodiment of the signalling device in its lowered or signalling position.

The embodiment of the signalling device of the present invention as illustrated in FIG. 4 is identical to that shown in FIG. 3 except for the stop means for limiting the movement of signalling device 40 when it reaches its lowered, signalling position. In this embodiment of the invention the distal portion 74 of the first end section 56 of filament or wire 46 is extended and bent to engage one of the side walls 16 to prevent further movement of signalling device 40 when it reaches its lowered, signalling position.

The stop means for restricting the movement of signalling device 40 illustrated in FIGS. 3 and 4 could be further modified without departing from the proper scope and fair meaning of the accompanying claims. For example, instead of being an integral part of the filament or wire 46, the stop means could be a projection extending from either the second hinge member 48 or the side wall 16 which supports the signal device 40 which would engage intermediate section 58 of filament or wire 46 when signalling device 40 reached its lowered, signalling position.

Figure 5:
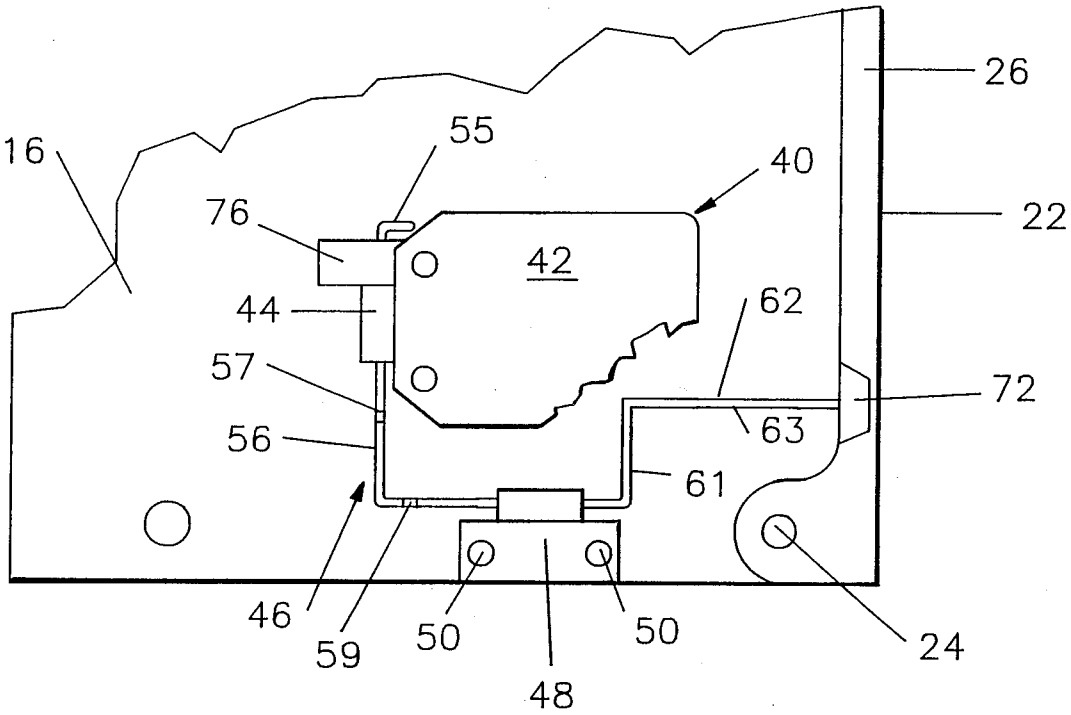
FIG. 5 is a view similar to FIG. 3 of yet another embodiment of the present invention.

The embodiment of the signalling device of the present invention as illustrated in FIG. 5 is similar in many respects to those illustrated in FIGS. 3 and 4, and in describing the embodiment of FIG. 5, the same reference numerals will be used to designate the similarities. The signalling device is generally designated by reference numeral 40 and comprises a flag plate 42, a first hinge member 44, a rigid wire or filament 46, a second hinge member 48 and screws 50 (or any other conventional means such as rivets, adhesives or the like) for securing the signalling device 40 to the forward portion of one of the side walls 16 of box 10 adjacent the pivot point 24 for swinging door 22. Flag plate 42 comprises an elongated, generally, rectangular shaped end portion 52 and a short springy portion 76 secured at one end of end portion 52. The generally rectangular shaped end portion 52 serves to provide the visual means for indicating that the mail carrier has left mail in box 10 with the short springy portion 76 serving as a means for urging face plate 42 against the side wall 16 of box 10, when signalling device 40 is in its raised, non-signalling position, to prevent the wind and other elements from causing the signalling device 40 to flap against the side wall 16 of box 10. The wire or filament 46 includes a first end section 56, an intermediate section 58 bent at an angle (preferably ninety degrees) from the first end section 56, and a second end section 62 comprising an inner portion 61 bent at an angle (preferably ninety degrees) to intermediate section 58 (and being generally parallel with first end section 56) and an outer portion 63 bent at an angle (preferably ninety degrees) to the inner portion 61 (and being generally parallel with intermediate section 58). Flag plate 42 is secured to the first hinge member 44 through rivets 66 or other conventional means such as screws, adhesives or the like, and is pivotably mounted on the first end section 56 of wire 46 by the first hinge member 44. The first end section 56 of wire 46 is bent at its distal portion as shown at 55 and crimped as shown at 57 to restrict sliding movement of the first hinge member 44 and flag plate 42 along first end section 56. The intermediate section 58 of wire 46 is pivotably supported by second hinge member 48 and is crimped as shown at 59 to engage the side wall 16 to provide a stop for limiting the movement of the signalling device 40 when it falls to its lowered, signalling, position The outer portion 63 of second end section 62 is of such a length that it extends to the forward end of side wall 16 of mailbox 10 so that its distal end can be tucked under flange or lip 26 of door 22 when the door 22 is closed and signalling device 40 is in a raised, non-signalling position.

Only the operation of the embodiment of FIGS. 2 and 3 will be described, as the operation of the other embodiments of the invention are similar and will be obvious after learning of the operation of this embodiment.

When the mail carrier opens the door 22 to place mail into box 10, the distal end of second end section 62 of filament 46 is released by flange or lip 26, thus causing the signalling device 40 to be lowered to its signalling position due to gravity about pivot points at first hinge member 44 and second hinge member 48 to provide an indication that mail has been placed into box 10. The mail carrier, after placing mail into box 10, closes the door 22, leaving signalling device 40 in its lowered, signalling position. When the mail is removed from the box 10, the owner (or the person removing the mail from box 10) merely raises the signalling device 40, which pivots about its pivot points to the non-signalling position (as shown in FIG. 1), places the distal end of second end section 62 of filament 46 next to the side wall 16 and closes door 22 so that the lip or flange 26 closes over the distal end of second end section 62 of filament 46 to hold the signalling device 40 in its raised non-signalling position until the mail carrier again places mail into the box.

While the above description constitutes preferred embodiments of the present invention, it will be appreciated that the invention is susceptible to modification, variation and change without departing from the proper scope and fair meaning of the accompanying claims.

I claim:

1. A self-contained signalling device having a raised, non-signalling position, and a lowered, signalling position, and adapted for attachment to a standard mailbox having a top wall, substantially vertical side walls, a bottom, and an open front end capable of being closed by an outwardly, downwardly, swinging door pivotably mounted thereto, said door having a lip portion which surrounds the outer surface of the forward edges of said side walls and said top wall when said door closes said open front end, said signalling device comprising:

a flag;

flag support means disposed for pivotal support of said flag and for displacement thereof between said non-signalling and signalling positions, said flag support means including an arm having pair of spaced end sections and a joining intermediate section, one of said end sections being disposed for engaged relation with said door responsive to closing thereof for retention of said flag in said non-signalling position and for disengagement from said door responsive to opening thereof whereby said flag is pivotably displaced to said signalling position; and, stop means for limiting the movement of said flag responsive to said pivotal displacement thereof.

2. The self-contained signalling device of claim 1 including first hinge means for pivotal support of said flag support means on one of said vertical side walls, said first hinge means providing for pivotal movement of said flag support means relative to said one vertical side wall.

3. The self-contained signalling device of claim 2 including second hinge means for pivotal support of said flag relative to said flag support means.

4. The self-contained signalling device of claim 3 wherein said one of said pair of end sections is disposed for substantially parallel, adjacent, relation with said one of said vertical side walls when said flag is in said non-signalling position, said non-signalling position being defined as a position wherein said flag is disposed in substantially parallel relation with said one of said vertical side walls.

5. The self-contained signalling device of claim 4, wherein said one of said pair of end sections is disposed in spaced extended relation relative to said one of said vertical side walls when said flag is in said signalling position, said signalling position being defined as a position wherein said flag is extended away from said one of said vertical side walls and in depending relation with said flag support means.

6. The self-contained signalling device of claim 5 wherein said door is provided with flag support retention means for coaction with said one end of said flag support means for retention of said flag in said non-signalling position responsive to closing of said door.

7. The self-contained signalling device of claim 6 wherein arm is formed from a rigid wire which incorporates said pair of spaced end sections and said intermediate section.

8. The self-contained signalling device of claim 7 wherein each of said pair of spaced end sections is at an angle relative to said intermediate section.

9. The self-contained signalling device of claim 8 wherein each of said angles between said sections is in the order of ninety degrees.

10. The self-contained signalling device of claim 9 wherein said flag includes means for holding said flag against said one vertical side wall of said mailbox when said device is in its raised, non-signalling position.

11. The self-contained signalling device of claim 10 wherein said stop means for limiting the movement of said flag comprises a bend in one of said end sections of said rigid wire.

12. The self-contained device of claim 11 wherein said bend in one of said end sections of said rigid wire for limiting the movement of said flag is at the distal, free, end of said one end section of said rigid wire.

13. A self-contained signalling device having raised and lowered positions and adapted for attachment to a standard mailbox having a top wall, substantially vertical side walls, a bottom, and an open front end capable of being closed by an outwardly, downwardly, swinging door pivotably mounted thereto, said door having a lip portion which surrounds the outer surface of the forward portions of said side walls and said top wall when said door closes said open front end, said signal device comprising:

a first hinge member secured to one of said side walls;

a rigid wire including a first end section pivotably secured to said first hinge member, an intermediate section bent at an angle relative to said first end section, and a second end section bent at an angle relative to said intermediate section in a direction opposite to that of said first end section, said rigid wire being movable about said first hinge member between said raised and lowered positions;

a flag plate;

a second hinge member secured to said flag plate and mounted on said intermediate section of said rigid wire; and means for restricting the movement of said rigid wire when it reaches said lowered position;

said second end section of said rigid wire being adapted to be placed under said lip portion of said door when it closes said open end of said box to hold said wire in its said raised position and to be released by such lip portion of said door when said door is opened to allow said wire to pivot about said first hinge member and fall to its said lowered position.

14. The self-contained signal device of claim 13 wherein each of said angles between said sections of said rigid wire is in the order of ninety degrees.

15. The self-contained signal device of claim 14 wherein said flag plate includes means for holding said flag plate against said one side wall of said mailbox when said device is in its raised, non-signalling, position.

16. The self-contained signal device of claim 15 wherein said means for restricting the movement of said rigid wire when said device reaches its lowered, signalling, position comprises a bend in said first end of said rigid wire.

17. A mailbox comprising a housing having an open forward end, side walls, and a floor;

a door hinged at its lower end for movement about an axis between a first, closed position and a second, open position;

a signal device mounted on one of said side walls of said housing for rotation about an horizontal axis between a raised, non-signalling position, to a lowered, signalling position, said signal flag comprising a first hinge member secured to said one side wall of said housing, a rigid wire including a first end section, an intermediate section and a second end section, a second hinge member mounted on said intermediate section of said rigid wire, a flag plate secured to said second hinge member, and means for restricting the movement of said rigid wire when said signal device is in its lower, signalling position, and means integral with said door and operable as said door is moved between its said first, closed position to its said second open position to release said second end section of said rigid wire of said signal device to cause said signal device to move to its said signalling position.

18. The mailbox of claim 10 wherein each of said first end section, said intermediate section and said second end section of said rigid wire is bent at an angle relative to its adjoining section.

19. The mailbox of claims 18 wherein each of said angles is in the order of ninety degrees.

20. The mailbox of claim 19 wherein said flag plate includes means for holding said flag plate against said one of said side walls when said signal device is in its raised, non-signalling, position, and said means for restricting the movement of said rigid wire when said signal device reaches its lowered, signalling position, comprises a bend in the distal end of said first end section of said rigid wire.

* * * * *